US005355641A

United States Patent [19]

Levy

[11] Patent Number: 5,355,641

[45] Date of Patent: Oct. 18, 1994

[54] TRIANGULATED CABLE DOME WITH RETRACTABLE ROOF

[75] Inventor: Matthys P. Levy, New York, N.Y.

[73] Assignee: Weidlinger Associates, Inc., New York, N.Y.

[21] Appl. No.: 968,090

[22] Filed: Oct. 29, 1992

Related U.S. Application Data

[63] Continuation-in-part of Ser. No. 608,497, Nov. 2, 1990, Pat. No. 5,259,158.

[51] Int. Cl.[5] ..... E04B 7/16

[52] U.S. Cl. ..... 52/66; 52/6; 52/64

[58] Field of Search ..... 52/6, 66, 81.2, 64

[56] References Cited

U.S. PATENT DOCUMENTS

| | | | |
|---|---|---|---|
| 4,265,260 | 6/1979 | Gillis | 52/81.2 |
| 4,611,442 | 9/1986 | Richter | 52/81.2 |
| 4,676,033 | 6/1987 | Allen et al. . | |
| 4,682,449 | 7/1987 | Berger | 52/66 |
| 4,716,691 | 1/1988 | Allen et al. . | |
| 4,727,688 | 3/1988 | Kida et al. | 52/6 |
| 4,757,650 | 7/1988 | Berger . | |
| 4,831,792 | 5/1989 | Berger | 52/6 |
| 4,920,707 | 5/1990 | Moskaliuk et al. | 52/6 |
| 4,942,698 | 7/1990 | Kumagai | 52/6 |
| 5,067,288 | 11/1991 | Takahama et al. | 52/81.2 |
| 5,070,659 | 12/1991 | Brisbin et al. | 52/6 |
| 5,257,485 | 11/1993 | Kawaguchi et al. | 52/66 |

OTHER PUBLICATIONS

"Reaching for a High-Flying Market", ENR, pp. 36-39 (Jul. 14, 1988).

"Kumagai Gumi Retractable Roofed Stadium Technology", Technical Data Specification for Kumagai Gumi Co., Ltd., (May 10, 1990).

*Primary Examiner*—Carl D. Friedman
*Assistant Examiner*—Wynn E. Wood
*Attorney, Agent, or Firm*—Pennie & Edmonds

[57] ABSTRACT

A triangulated cable dome roof having a retractable roof portion includes a triangulated cable arrangement for supporting a roof membrane, a roof membrane which is fixed to a portion of the triangulated cable arrangement so that a portion of the underlying area is exposed, and a retractable roof portion movably secured to the triangulated cable arrangement. The retractable roof portion preferably includes one or more retractable roof sections, each of which is movable between a closed position in which the retractable roof sections overlay the uncovered portion of the triangulated cable arrangement and an opened position in which the retractable roof sections nest above the covered portion of the triangulated cable arrangement, thereby exposing a portion of the underlying area.

53 Claims, 12 Drawing Sheets

TRIANGULATED CABLE DOME WITH RETRACTABLE ROOF

CROSS-REFERENCE TO RELATED APPLICATIONS

This application is a continuation-in-part of application Ser. No. 07/608,497 filed Nov. 2, 1990 now U.S. Pat. No. 5,259,158.

BACKGROUND OF THE INVENTION

This invention relates to a triangulated cable dome which supports a roof for an underlying building, arena or stadium and which is provided with a retractable roof section. More particularly, it relates to a cable dome formed of a plurality of tension members and compression members arranged in a triangulated manner for supporting a roof, and a retractable roof for the cable dome.

In the modern era of sports and entertainment, domed stadiums have become the vogue. Starting in the 1960s and 1970s, several domed multipurpose stadiums were built. These stadiums were designed to eliminate weather as a factor in sporting and entertainment events, thereby increasing stadium use and revenue. In my co-pending parent application, Ser. No. 07/608,497 filed Nov. 2, 1990, I described some of the many mechanical and structural shortcomings of these early domed structures. While some domed structures, namely those of the type described in U.S. Pat. No. 3,139,957 to Fuller and U.S. Pat. No. 4,736,553 to Geiger, overcome some of the shortcomings of the earlier designs by using the principles of catenary suspension, these structures had limited application to non-circular areas.

Recently, there has been a demand for arenas or stadiums having a roof or a portion of a roof that may be opened or closed depending on the weather. When closed, the roof keeps out inclement weather thereby protecting the floor or field of the arena and the spectators so that the event may be held. Conversely, when the weather is favorable, the roof may be opened to allow the spectators to enjoy the weather as well as the event. Such a stadium is particularly desirable where a natural playing surface, such as grass, is used, since natural grass cannot be easily grown indoors. Until now, sports, such as soccer, which are preferably played on natural grass, have been played outdoors and are therefore subject to the forces of nature. A domed stadium with a retractable roof or roof section allows grass to be grown thereby allowing these sports to be played indoors on a grass field. Accordingly, a domed stadium that has a portion or section of roof that is retractable is desired. Such a stadium provides protection to the fans, the players and the playing surface during inclement weather but also allows the fans and players to enjoy fair weather. Moreover, the roof allows for the use of natural grass in a dome enclosed arena.

One retractable domed stadium is illustrated in U.S. Pat. Nos. 4,676,033 and 4,716,691 to Allen et al. which describe the recently constructed Sky-Dome in Toronto, Canada. These patents illustrate a stadium that is circular in plan and has two parallel, rectangular wings running along opposite sides of the circular stadium. The domed roof of the stadium includes four arched roof panels; a fixed ungular end segment, a movable ungular end segment that rotates on a circular track into a nesting relationship with the fixed end segment and a pair of central arches which are movable to rest above the nesting end segments.

Significantly, this retractable roof is constructed of rigid structural members and suffers from numerous shortcomings. First, the use of rigid structural members is inefficient, resulting in a roof structure that is extraordinarily heavy and complicated. Second, due to the weight and complex movements of the individual roof panels, the roof is slow to open or close, thereby subjecting the stadium occupants to dangerous conditions should the weather change quickly. Third, the complex nature and movements of the movable panels leads to a stadium that is costly to construct and to maintain.

In light of these shortcomings, it is desirable to provide a domed stadium having a retractable roof section which is lightweight, inexpensive to build and maintain, and simple to construct and operate.

SUMMARY OF THE INVENTION

I have devised a cable dome having a retractable roof portion for an underlying building structure, such as a stadium, arena or the like, which overcomes the disadvantages and shortcomings of the above-mentioned prior art structures. Specifically, I have devised a lightweight triangulated cable dome having a retractable roof portion. Advantageously, the triangulated cable dome may be used with non-circular or circular underlying structures. Moreover, the triangulated structure more efficiently utilizes the tensile property of the building materials thereby creating a lightweight, cost-efficient design.

In accordance with the present invention, a cable dome roof having a retractable roof portion is disclosed. The cable dome roof includes a triangulated cable arrangement for supporting a roof membrane, a roof membrane which is fixed to a portion of the triangulated cable arrangement so that a portion of the underlying arena is exposed, and a retractable roof portion movably secured to the triangulated cable arrangement so that the retractable roof portion is movable between a closed position in which the retractable roof portion overlays the uncovered portion of the triangulated cable arrangement, and an opened position in which the retractable roof portion nests above the covered portion of the triangulated cable arrangement, thereby exposing a portion of the underlying arena. Preferably, the retractable roof portion includes one or more retractable roof sections which are movably secured to the cable arrangement to provide a domed structure that may be opened or closed as desired.

In one embodiment, the cable arrangement defines an enclosed area for an underlying building space having a non-circular perimeter including major and minor axes. The triangulated structure includes a substantially horizontal outer compression ring, first and second fixed end sectors and an intermediate segment that extends from one end sector to the other end sector. Preferably, a substantially planar cable truss is positioned along the major axis extending from the first end sector to the second end sector. The triangulated cable arrangement also includes a plurality of hoop-like tension members concentrically arranged within the non-circular curve at different heights relative to a common reference plane, a plurality of substantially vertical compression members located on each of the hoop-like tension members, and a plurality of tension elements interconnecting each compression member on a first hoop-like tension member to a pair of compression members on an adjacent hoop-like tension member.

The triangulated cable arrangement of the present invention is advantageously provided with means for supporting and guiding the retractable roof sections as they move between the opened and closed positions. The support means may be any track, rail, groove, guide or magnetic system capable of supporting and guiding the relative movement of the retractable roof sections to the triangulated cable arrangement.

In another embodiment, the cable arrangement defines an enclosed area for an underlying building space having a circular perimeter.

I have also devised a lightweight, inexpensive and simple retractable roof portion which will open and close quickly and easily. The retractable roof portion is of sufficient size to cover, in the closed position, the exposed portion of the stadium. The retractable roof portion includes one or more retractable roof sections, each of which further includes an array of support members, such as trusses. Preferably, the trusses are constructed of lightweight alloys, such as aluminum. In the case where the underlying building space has a non-circular perimeter, the trusses are organized in rows and columns. In each row of the retractable roof section, the trusses are flexibly interconnected so that the roof section is conformable to the contour of the underlying support structure. Similarly, the trusses in each column of the retractable roof section are flexibly linked to one another so that the roof section is conformable to the contour of the underlying support structure when the retractable roof section is moved between the opened and closed positions.

In the case where the underlying building has a circular perimeter, the rows and columns of the trusses extend along radial lines and concentric circles, respectively. In this embodiment, the retractable roof sections are rotatable between the opened and closed positions.

The retractable roof section also includes means for movably securing the array of trusses to the underlying structure so that the array is movable relative to the structure. For example, the array may be provided with wheel means which engage a system of rails on the underlying structure.

As described above, I have devised a cable dome having a retractable roof portion that can be easily opened or closed as desired. In this manner, I have provided a lightweight, economical structure having all the benefits of a cable structure and a retractable domed structure.

BRIEF DESCRIPTION OF THE DRAWINGS

These and other objects, features and advantages of my invention will be more readily apparent from the following detailed description of the preferred embodiments of the invention in which.

DETAILED DESCRIPTION OF THE PREFERRED EMBODIMENT

Figure 1:
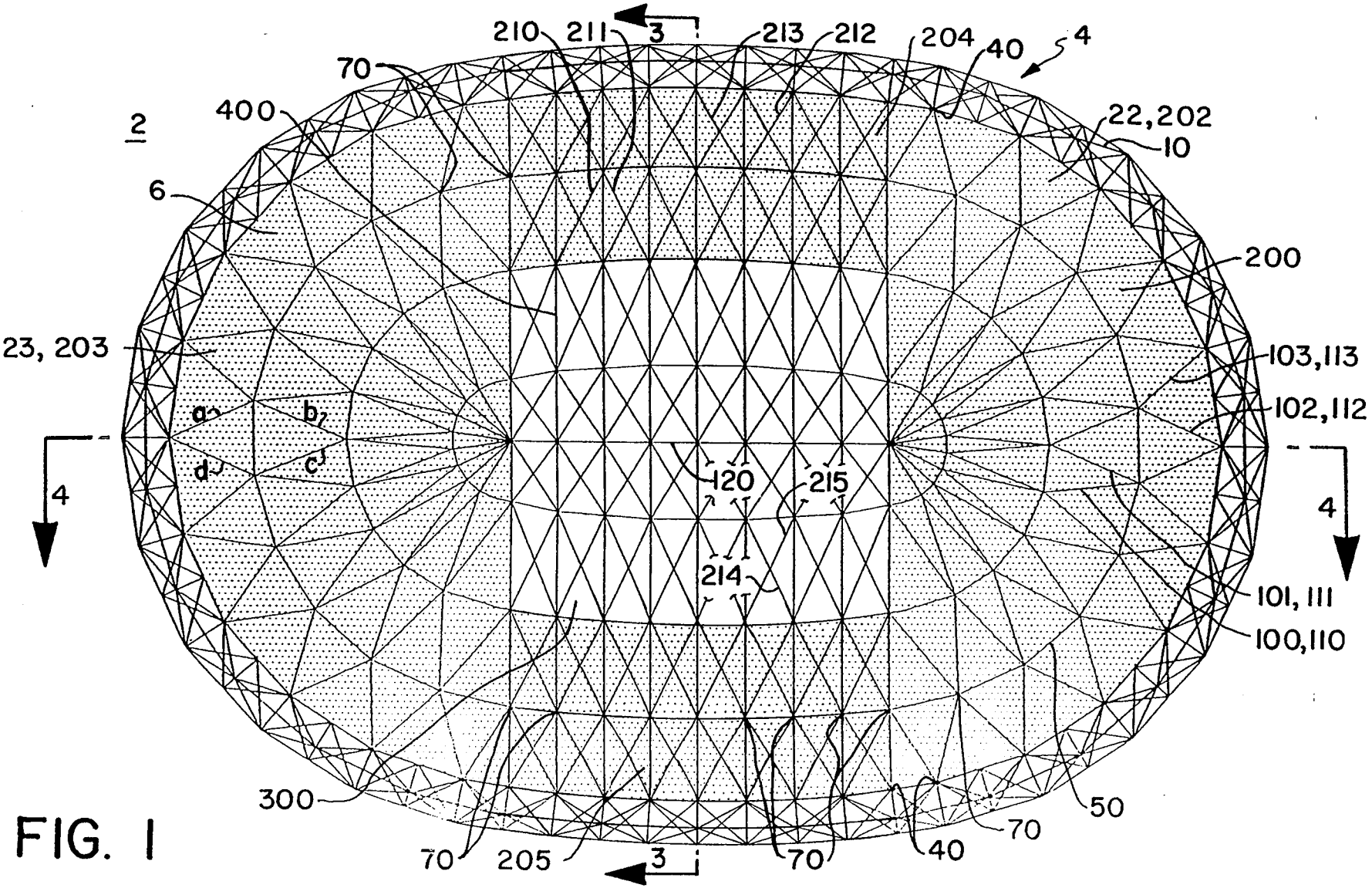
FIG. 1 is a top plan view of a cable dome in accordance with one embodiment of the present invention.
Figure 5:
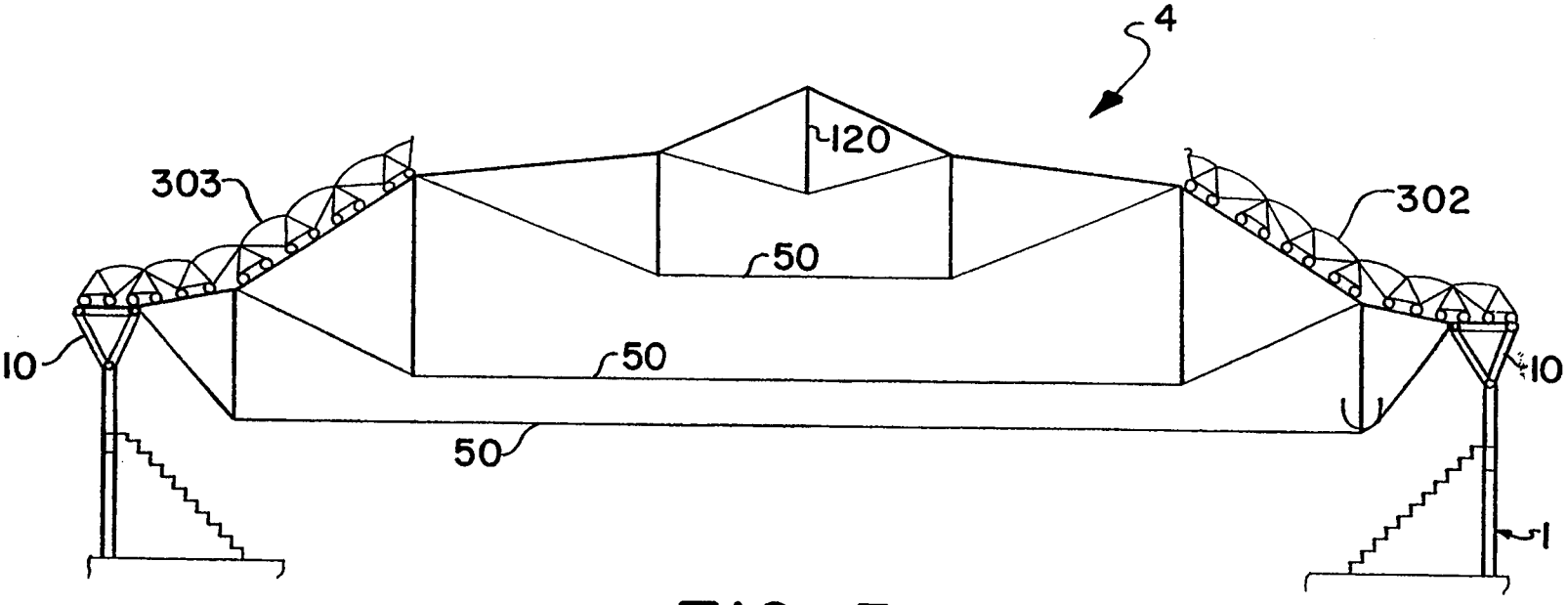
FIG. 5 is a view similar to FIG. 3 but showing the retractable roof sections in the opened position.

FIG. 1 illustrates, in plan view, one embodiment of a triangulated cable dome 2 having a retractable roof portion designed in accordance with my invention. Cable dome 2 includes a triangulated cable arrangement 4 which is partially covered with a flexible membrane 6 forming a fixed roof portion 200 (shaded area) which defines a partially enclosed area for an underlying building space 1 having a non-circular perimeter. Cable dome 2 also includes a retractable roof portion 300 which is movably secured to triangulated cable arrangement 4. In the preferred embodiment, retractable roof portion 300 includes a pair of retractable roof sections 302, 303 (FIGS. 3 and 5) which are each moveable between a closed position in which the sections overlay the uncovered portion of triangulated cable arrangement 4 (FIG. 3) and an opened position in which retractable roof sections 302, 303 nest above fixed roof portion 200 (FIG. 5).

Figure 2:
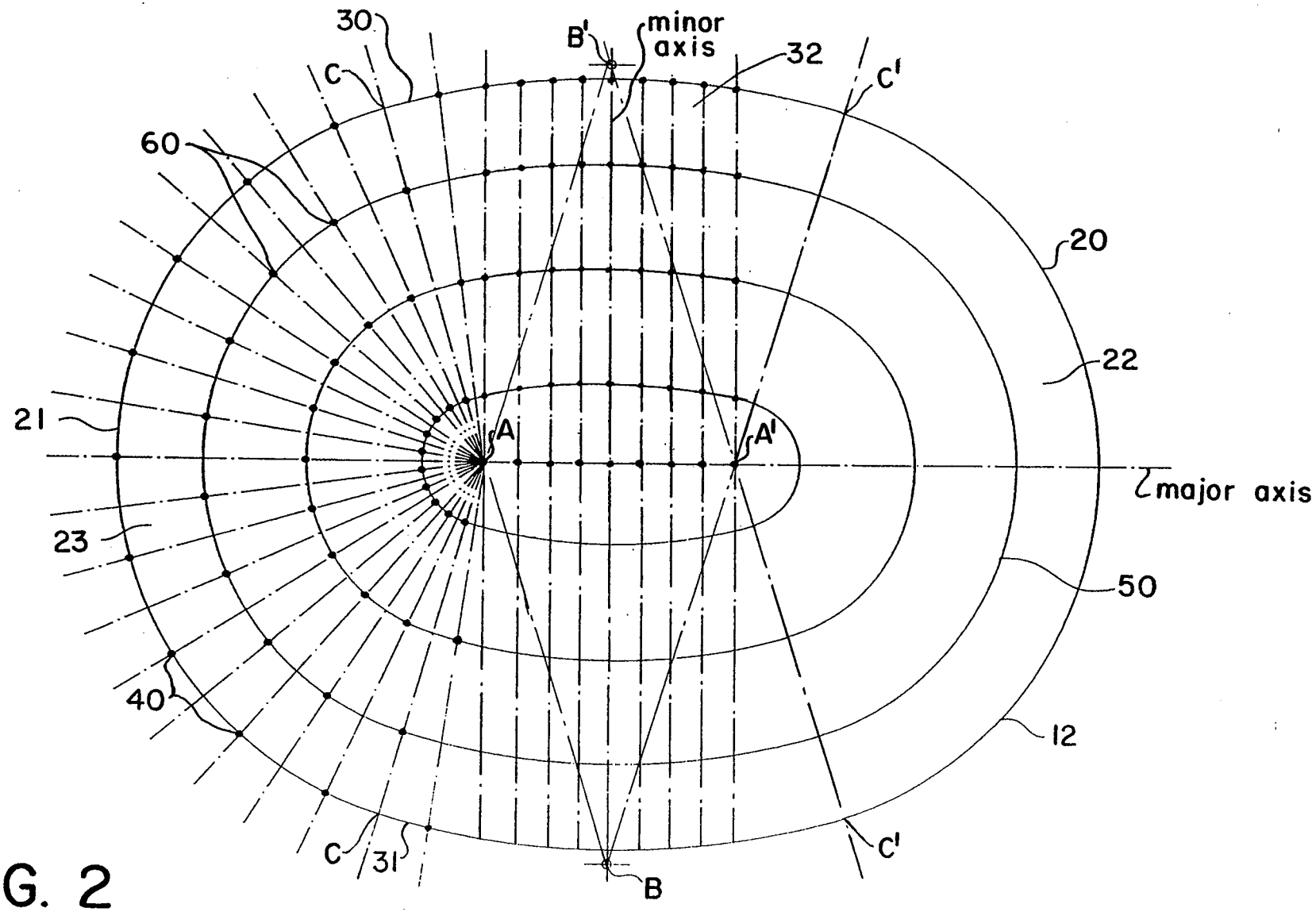
FIG. 2 is a top plan view useful in understanding the present invention.

FIG. 2 illustrates the location of the structural members of triangulated cable arrangement 4 in the non-circular embodiment of FIG. 1. In this embodiment, an underlying building space 1 is provided having a non-circular plan, including major and minor axes. A non-circular curve 12, which closely approximates the perimeter of underlying building space 1, is constructed from a plurality of circular arcs. Non-circular curve 12 includes a first pair of circular arcs 20, 21 having their centers A, A′ on the major axis of the non-circular curve formed by the perimeter of underlying building structure 1. Centers A, A′ of circular arcs 20, 21 are equidistant from the minor axis and on opposite sides. Non-circular curve 12 further includes a second pair of circular arcs 30, 31 having centers B, B′ located on the minor axis of the non-circular curve formed by the perimeter of underlying building structure 1. Centers B, B′ of circular arcs 30, 31 are equidistant from the major axis and on opposite sides. As shown in FIG. 2, first pair of circular arcs 20, 21 and second pair of circular arcs 30, 31 intersect at C and C′ to form non-circular curve 12. A pair of lines CAC and C′A′C′ separate end sectors 22, 23 from intermediate segment 32. Intermediate segment 32 projects in plan a substantially butterfly shaped figure which extends from end sector 22 to end sector 23. Thus, end sectors 22, 23 combine with intermediate segments 32 to form the area enclosed by non-circular curve 12.

Triangulated cable arrangement 4 includes a compression ring 10 having a non-circular plan which substantially matches the perimeter of underlying building space 1. As disclosed in my co-pending application, Ser. No. 07/608,497 filed Nov. 2, 1990, the contents of which are expressly incorporated herein by reference, compression ring 10 may comprise a concrete box girder or a triangular truss. According to the present invention, compression ring 10 rests upon a number of concrete support columns or other suitable foundation which may extend upward from underlying structure 1. Non-circular curve 12 is constructed on compression ring 10 as described above.

Figure 3:
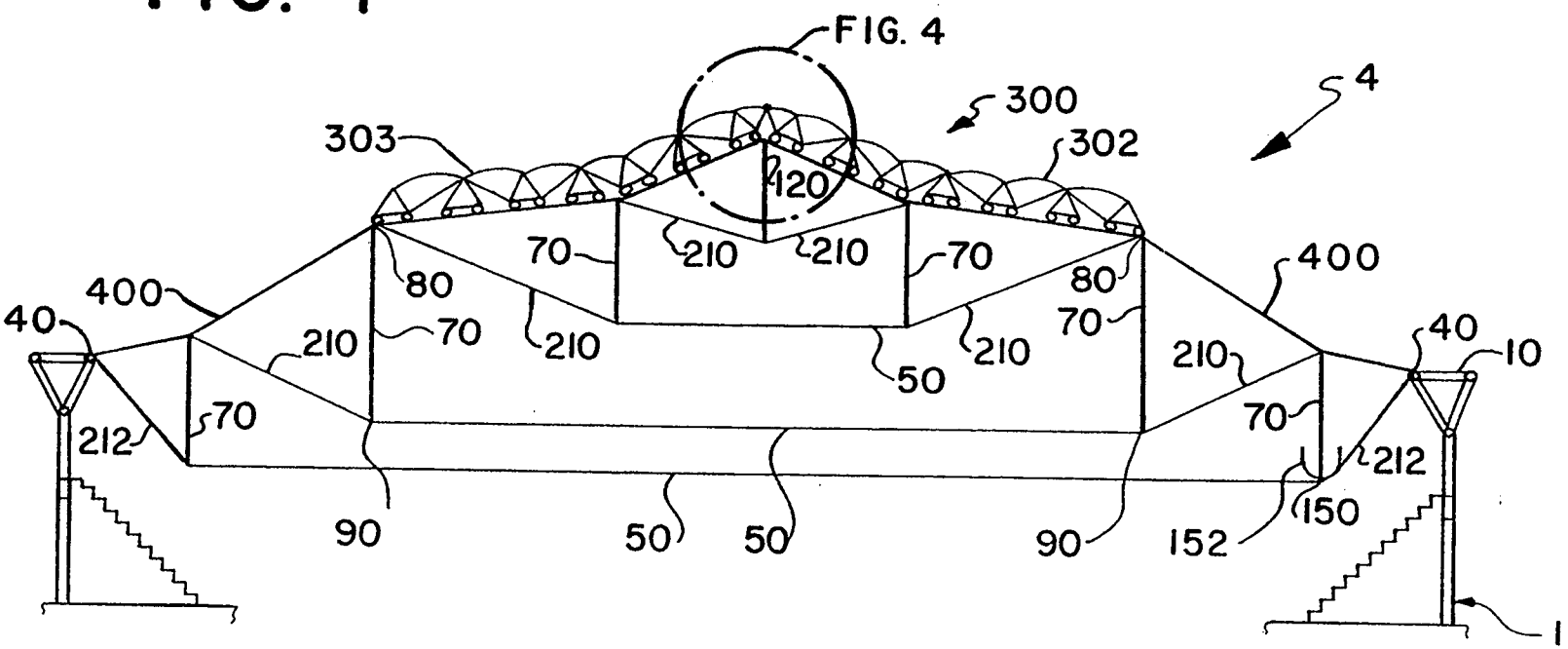
FIG. 3 is a view along the minor axis of the non-circular embodiment of FIG. 1, showing a pair of retractable roof sections in the closed positions.

As shown in FIGS. 1–3, triangulated cable arrangement 4 also includes a plurality of hoop-like tension members 50 which are concentrically arranged within non-circular curve 12 at different heights relative to a common plane. Vertical compression members 70, having upper and lower ends, are attached at their lower ends to each tension member 50 at spaced-apart locations 60 on the tension member, as indicated in FIG. 2. The upper ends of compression members 70 define upper attachment points or nodes 80 and the lower ends define lower attachment points or nodes 90. In end sectors 22, 23 compression members 70 are located on each hoop-like tension member 50 such that a compression member 70 on a first hoop-like tension member 50 and a proximal pair of compression members 70 on an adjacent hoop-like tension member 50 form, in plan, the vertices of a substantially isosceles triangle. Similarly, attachment points (or nodes) 40 are located on outer compression ring 10 such that a node 40 located on outer compression ring 10 and a proximal pair of compression members 70 on an outermost hoop-like tension member 50 form, in plan, the vertices of a substantially isosceles triangle.

Conversely, in intermediate segment 32 compression members 70 are located on each hoop-like tension member 50 in columns generally parallel to the minor axis of non-circular curve 12 but which follow the butterfly shape outlined by lines CAC and C'A'C' when viewed in plan. In similar fashion, nodes 40 on compression ring 10, lying within intermediate segments 32 are located along the columns of compression members 70.

Cable arrangement 4 further includes a plurality of tension elements for interconnecting each compression member 70 affixed to a first hoop-like tension member 50 to a proximal pair of non-aligned (i.e., not aligned with the column of compression members 70 in which compression member 70 lies) compression members 70 affixed to an adjacent hoop-like tension member 50.

Figure 6:
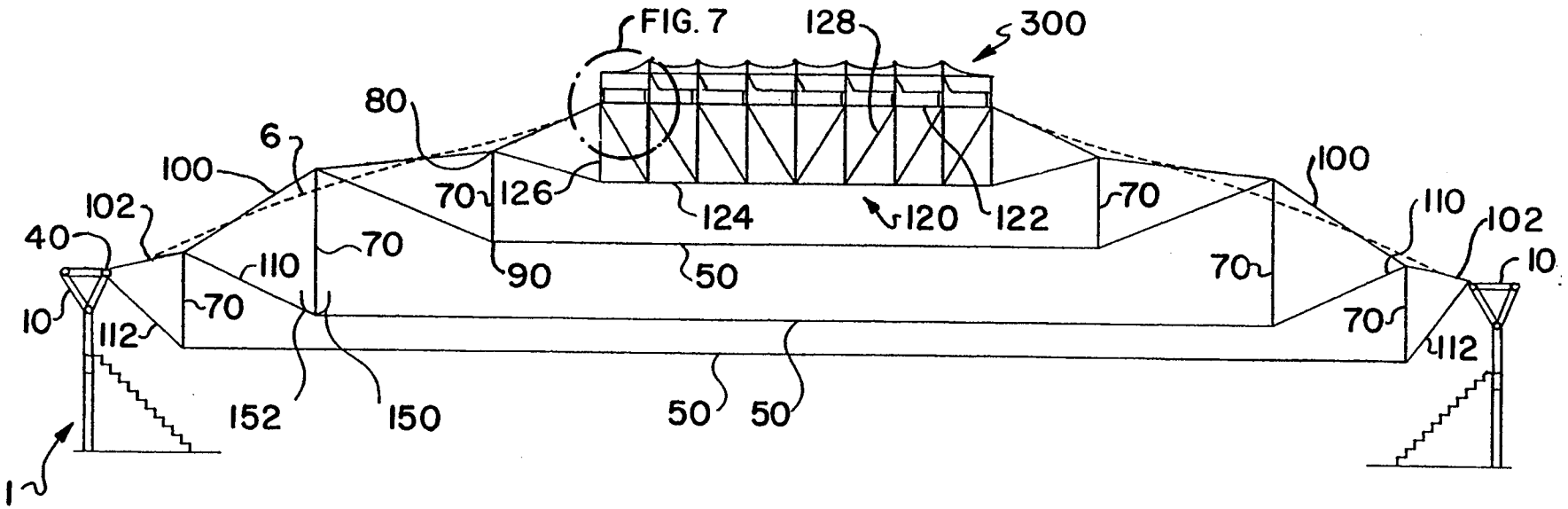
FIG. 6 is a view along the major axis of the non-circular embodiment of FIG. 1.

As best shown in FIGS. 1 and 6, in the end sectors 22, 23, these tension elements include: a first upper tension member 100 extending from upper node 80 of compression member 70 affixed to a first hoop-like tension member 50 to upper node 80 of one of the proximal pair of compression members 70 affixed to the adjacent hoop-like tension member 50; a second upper tension member 101 extending from upper node 80 of compression member 70 affixed to the first hoop-like tension member 50 to upper node 80 of the other one of the proximal pair of compression members 70 affixed to the adjacent hoop-like tension member 50; a first diagonal tension member 110 extending from upper node 80 of compression member 70 affixed to the first hoop-like tension member 50 to lower node 90 of one of the proximal pair of compression members 70 affixed to adjacent hoop-like tension member 50; and a second diagonal tension member 111 extending from upper node 80 of compression member 70 affixed to the first hoop-like tension member 50 to lower node 90 of the other one of the proximal pair of compression members 70 affixed to adjacent hoop-like tension member 50.

As best shown in FIGS. 1 and 3, in intermediate segment 32, the tension elements include: a first diagonal tension member 210 extending from upper node 80 of each compression member 70 affixed to the first hoop-like tension member 50 to lower node 90 of one of a proximal pair of non-aligned (i.e. not aligned with the column of compression members 70 in which compression member 70 lies) compression members 70 affixed to the adjacent hoop-like tension member 50; and a second diagonal tension member 211 extending from upper node 80 of each compression member 70 affixed to the first hoop-like tension member 50 to lower node 90 of the other one of the proximal pair of non-aligned compression members affixed to adjacent hoop-like tension member 50. As seen in FIG. 1, when viewed in plan, diagonal tension members 210, 211 criss-cross.

The triangulated structure of the present invention also includes means for securing the outermost hoop-like tension member 50 and compression members 70 attached thereto to compression ring 10. In the preferred embodiment, a plurality of tension elements interconnect each compression member 70 affixed to outermost hoop-like tension member 50 to a proximal pair of nodes 40 on compression ring 10.

Preferably, as shown in FIGS. 1 and 6, the plurality of tension elements in end sectors 22, 23 include: a first upper tension member 102 extending outwardly from upper node 80 of compression member 70 affixed to outermost hoop-like tension member 50 to one of the proximal pair of nodes 40 on compression ring 10; and second upper tension member 103 extending outwardly from upper node 80 of compression member 70 affixed to outermost hoop-like tension member 50 to the other one of the proximal pair of nodes 40 on compression ring 10; a first lower tension member 112 extending outwardly from lower node 90 of compression member 70 affixed to outermost hoop-like tension member 50 to one of the proximal pair of nodes 40 on compression ring 10; and a second lower member 113 extending outwardly from lower node 90 of compression member 70 affixed to outermost hoop-like tension member 50 to the other one of the proximal pair of nodes 40 on compression ring 10.

As shown in FIGS. 1 and 3, however, the plurality of tension elements in intermediate segment 32, include: a first lower tension member 212 extending outwardly from lower node 90 of each compression member 70 affixed to outermost hoop-like tension member 50 to one of a non-aligned proximal pair of nodes on compression ring 10; and a second lower member 213 extending outwardly from lower node 90 of each compression member 70 affixed to the outermost hoop-like tension member 50 to the other one of the non-aligned proximal pair of nodes 40 in compression ring 10.

In the embodiment illustrated in FIGS. 1–12, a cable truss 120, shown in FIG. 6, is positioned along the major axis between centers A, A' of circular arcs 20, 21 to incorporate a triangulated geometry into a non-circular configuration. Cable truss 120 preferably includes an upper tension member forming a top chord 122, a lower tension member parallel to top chord 122 forming a bottom chord 124, and a plurality of compression members 126 having upper and lower ends. The lower ends of compressions members 126 are affixed to bottom chord 124, and the upper ends of compression members 126 are affixed to top chord 122. Cable truss 120 also includes a plurality of diagonal tension members extending from the upper end of a first compression member 126 to the lower end of an adjacent compression member 126, forming diagonal chords 128.

Triangulated cable arrangement 4 also includes a plurality of tension elements for interconnecting an innermost hoop-like tension member 50 and compression members 70 attached thereto to cable truss 120. These tension elements preferably interconnect each compression member 70 affixed to innermost hoop-like tension member 50 to at least one compression member 126 of cable truss 120.

One particular advantage of the present invention is that the number of structural members in tension is maximized to more efficiently utilize the tensile property of the building materials. Therefore, the structural members that are in tension are preferably formed of flexible materials such as cables. For example, hoop-like tension members 50, upper tension members 100–103, lower tension member 112, 113, 212, 213, diagonal tension members 110, 111, 210, 211, top chord 122, bottom chord 124, and diagonal chord 128 of cable truss 120, preferably comprise cable such as wire strand, or wire rope. Compression members 70 as well as compression members 126, of cable truss 120 are preferably rigid posts such as steel pipe.

For convenience, a network of catwalks 150 can be constructed on hoop-like tension members 50 to provide access for maintenance and installation personnel, as well as to provide mounting for service lighting, speakers and rigging for special events. Catwalks 150 may have handrails 152 on either side to provide safety.

Flexible membrane 6 overlies compression members 70 and the interconnecting tension elements in end sectors 22, 23, forming fixed roof end sectors 202, 203 of fixed roof portion 200, and a portion of intermediate segment 32, forming fixed roof intermediate sections 204, 205. Fixed roof portion 200 is shaded in FIG. 1. As seen in FIG. 1, fixed roof intermediate sections 204, 205 are positioned along compression ring 10 on either side of the major axis and extend inward a predetermined distance. Thus, flexible membrane 6 serves as a roof for partially enclosing the underlying structure. Preferably, fixed roof portion 200 is of a size and shape to leave at least the playing field or floor of underlying building space 1 exposed.

Membrane 6 may be formed by Teflon TM -coated fiberglass, silicone coated polyester, or corrugated steel, although it is contemplated that other materials such as canvas may also be used. Preferably, however, membrane 6 is constructed of Teflon TM -coated fiberglass.

Figure 4:
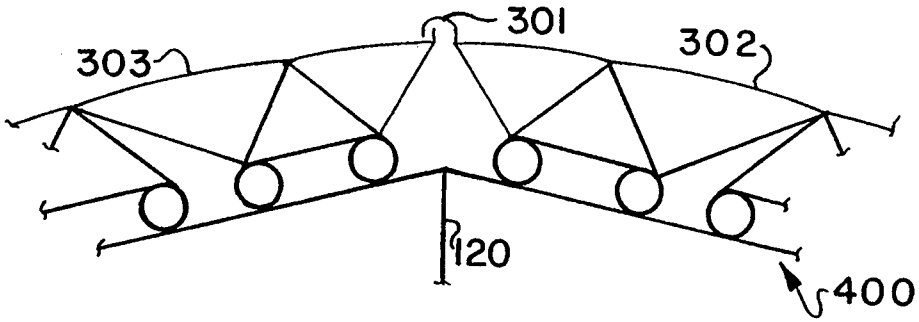
FIG. 4 is an exploded view of FIG. 3 showing the sealing relationship between the retractable roof sections when in the closed position.

Cable dome 2 further includes a retractable roof portion 300 (unshaded area in FIG. 1) which is movably secured to triangulated cable arrangement 4. In the preferred embodiment, retractable roof portion 300 comprises a pair of retractable roof sections 302, 303 (FIGS. 3 and 5) which are movable between a closed and opened position. In the closed position (FIG. 3), retractable roof sections 302, 303 overlay the uncovered portion of triangulated cable arrangement 4 and matingly engage along the major axis of non-circular curve 12 thereby completely enclosing underlying building space 2. Specifically, the retractable roof sections 302, 303 mate in the closed position via a sealing arrangement 301 (FIG. 4). The sealing arrangement ensures that water and other undesirable substances will not enter the dome when the roof is closed. In the opened position (FIG. 5), retractable roof sections 302, 303 nest above fixed roof intermediate sections 204, 205, respectively, thereby exposing at least a portion of the underlying building space.

Figure 7:
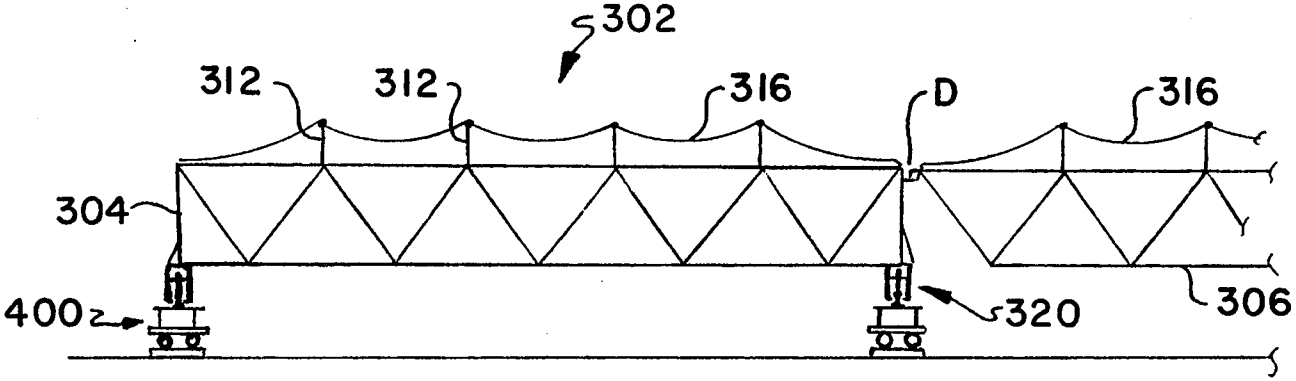
FIG. 7 is an enlarged view of a pair of flexibly interconnected trusses of a retractable roof section according to the invention.
Figure 8:
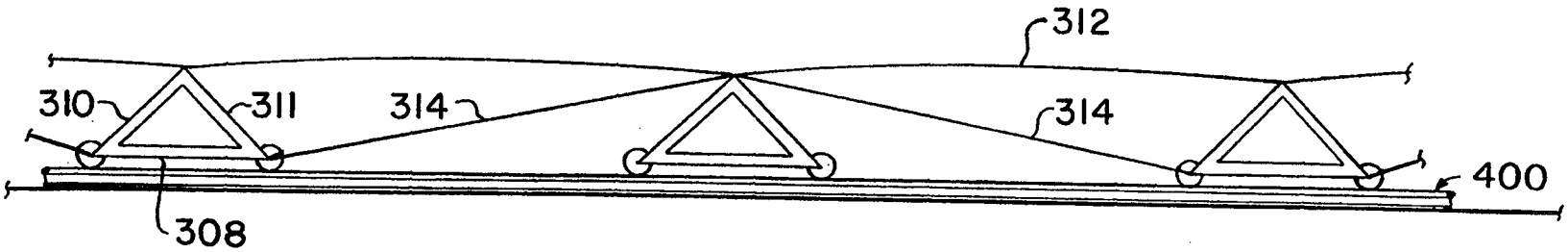
FIG. 8 is an enlarged partial end view of one retractable roof section according to the invention.

As shown in FIGS. 1, 3–8 and 12, each retractable roof section 302, 303 preferably comprises a substantially rectangular array of support members which are arranged in rows and columns, and are flexibly interconnected. In the preferred embodiment, a retractable roof section 302 comprises an array of triangular trusses. As shown in FIG. 8, each triangular truss further includes a base truss 308 and a pair of inclined side trusses 310, 311. As described above, the triangular trusses are arranged in rows and columns. Preferably, each row in the array includes alternating end trusses 304 and intermediate trusses 306 with a minimum of two end trusses and one intermediate truss. A means D (FIG. 7) is provided for flexibly interconnecting a first triangular truss in each row of the array to an adjacent triangular truss in that row. Means D may be any flexible interconnection, such as a hinge, which allows for relative movement between adjacent trusses within a row. Such a flexible interconnection allows a retractable roof section to conform to the shape of triangulated cable arrangement 4. Moreover, as shown in FIG. 7, flexible interconnection means D is designed to allow an intermediate truss 306 to be "hung" from an end truss 304 and each successive intermediate truss to be "hung" from the previous truss, to form a caterpillar train.

Flexible linking means are also provided for flexibly linking a first triangular truss in each column of the array to an adjacent triangular truss within the column. The flexible linking means may be any flexible connection which allows for relative movement between adjacent trusses within a column. In the preferred embodiment, the flexible linking means comprise a plurality of link members 314. As shown in FIG. 8, link members 314 extend alternatively from a lower vertex of a first triangular truss to the upper vertex of an adjacent triangular truss in the column, or from the upper vertex of a first triangular truss to a lower vertex of an adjacent triangular truss in the column. Link members 314 flexibly link the triangular trusses in each column so as to allow relative movement therebetween. This relative movement allows retractable roof section 302 to conform to the changing shape of triangulated cable arrangement 4 when the retractable roof sections are moved between the opened and closed positions.

Figure 9:
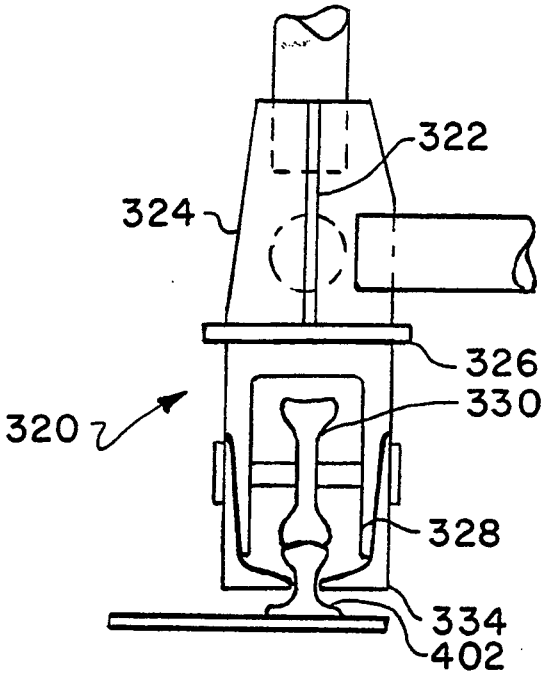
FIG. 9 is a front view of a wheel housing assembly and mating rail assembly for movably supporting a retractable roof section.
Figure 10:
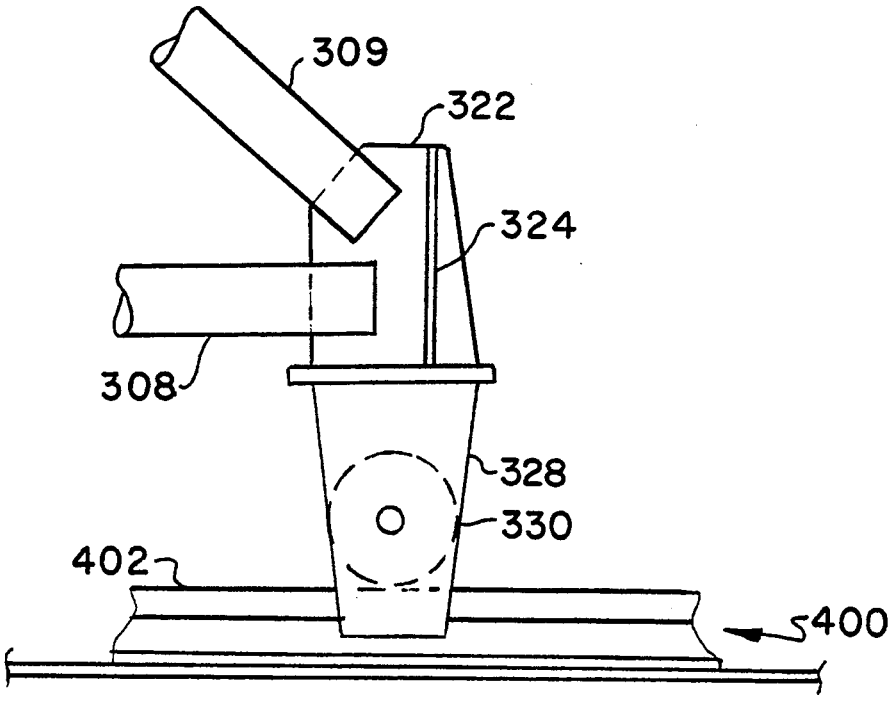
FIG. 10 is an end view of the wheel housing assembly and rail assembly of FIG. 9.
Figure 11:
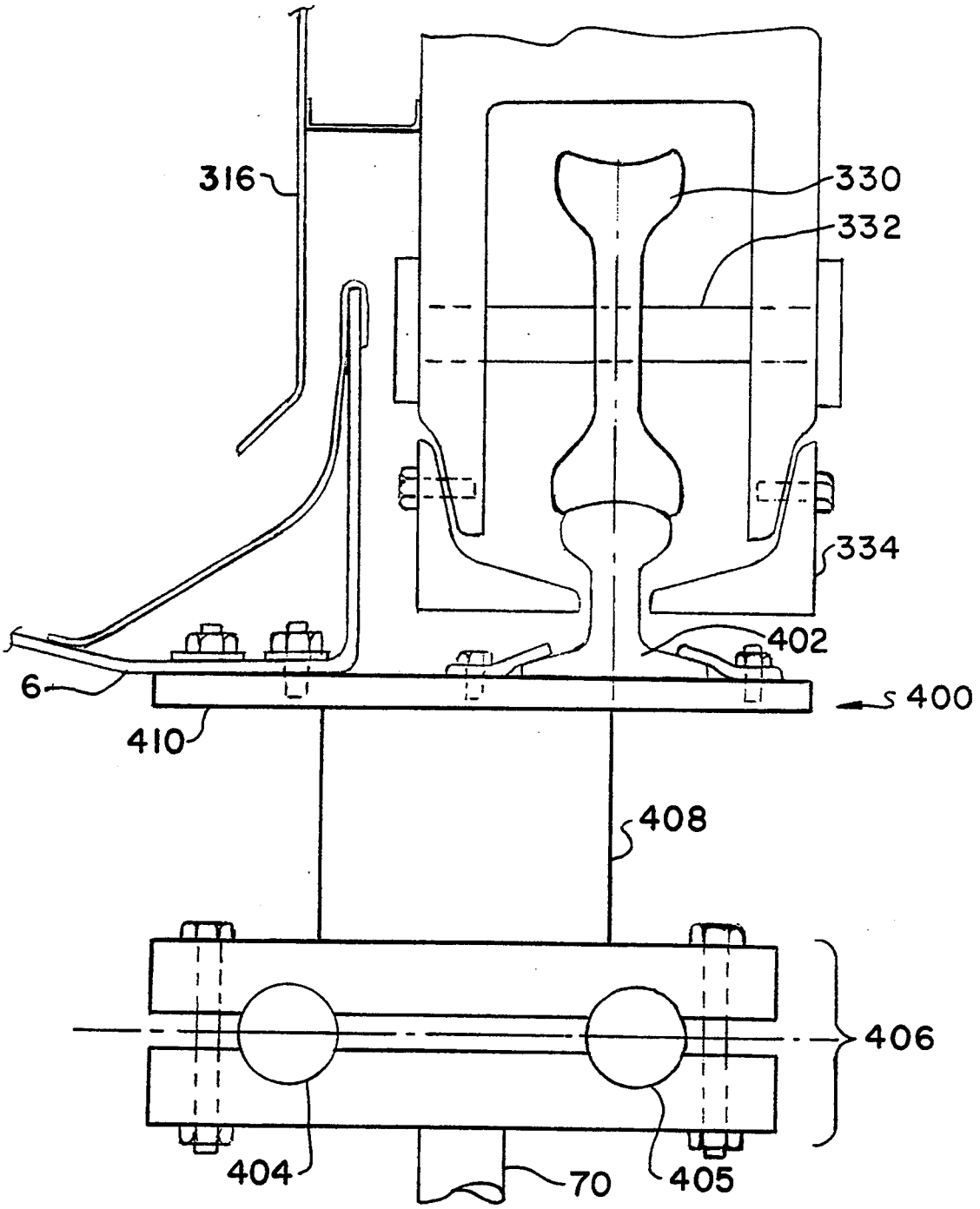
FIG. 11 is an enlarged view of the wheel housing assembly and rail assembly of FIG. 9.
Figure 12:
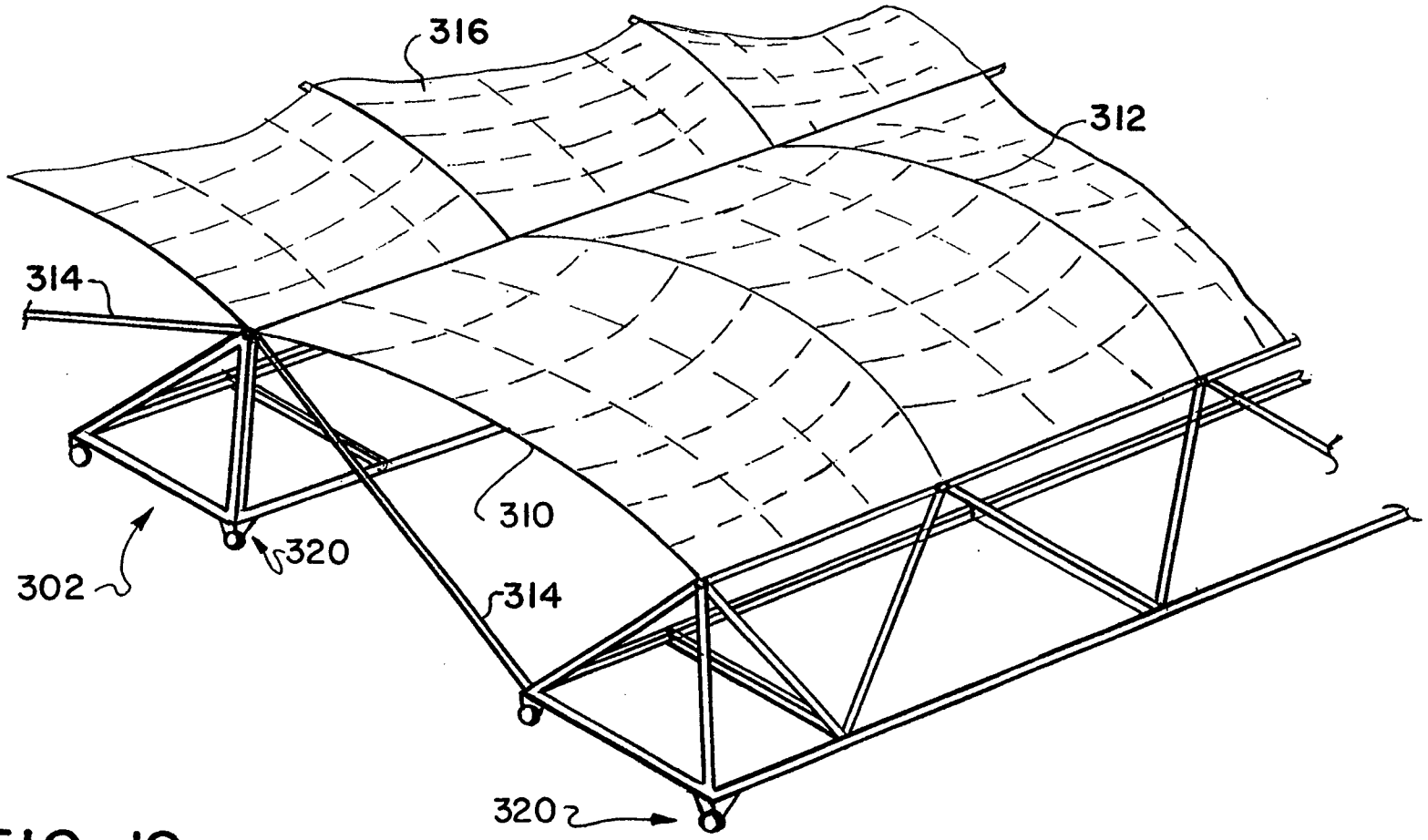
FIG. 12 is an isometric view of a retractable roof section according to the invention.

Means are also provided for supporting and guiding retractable roof sections 302, 303 as they are moved between the opened and closed positions. The support means may comprise any track, rail, groove, guide or magnetic system capable of supporting and guiding the movement of retractable roof sections 302, 303. In the preferred embodiment, the supporting means comprise providing each triangular truss in retractable roof sections 302, 303 with wheel means which engage a rail assembly 400 on triangulated cable arrangement 4. As shown in FIGS. 9–11, the wheel means preferably include a wheel housing assembly 320 having a wheel housing 328 and a wheel 330 rotatably mounted in wheel housing 328 on axle 332. Wheel 330 is designed for rolling engagement with a rail 402 in rail assembly 400. Wheel housing assembly 320 also includes an uplift restraint 334 to prevent disengagement of wheel 330 from rail 402.

Drive means are also provided to move retractable roof sections 302, 303 between the opened and closed positions. The drive means may include any mechanical or motorized device capable of causing a driving motion. Preferably, the drive means include providing selected wheel housing assemblies 320 with a drive motor. Alternatively, a cable pull system may be used which includes fixed motors and cable reels attached to triangulated cable arrangement 4 or underlying building 1, and a pulley system similar to that used for a cable car.

Rail assembly 400, on which retractable roof sections 302, 303 ride, includes a plurality of rails 402. Each rail 402 runs parallel to the minor axis of non-circular curve 12 and is positioned atop a column of compression members 70. Each rail 402 extends from the major axis of non-circular curve 12 to at least outer compression ring 10 thereby providing support to retractable roof sections 302, 303. As shown in FIG. 11, rail assembly 400 also includes a pair of ridge cables 404, 405, which are connected to upper ends 80 of compression members 70 by a connector 406. Support for rails 402 is provided by a plurality of posts 408 and plates 410 connected to connectors 406 which are attached to cables 404 and 405.

Figure 13:
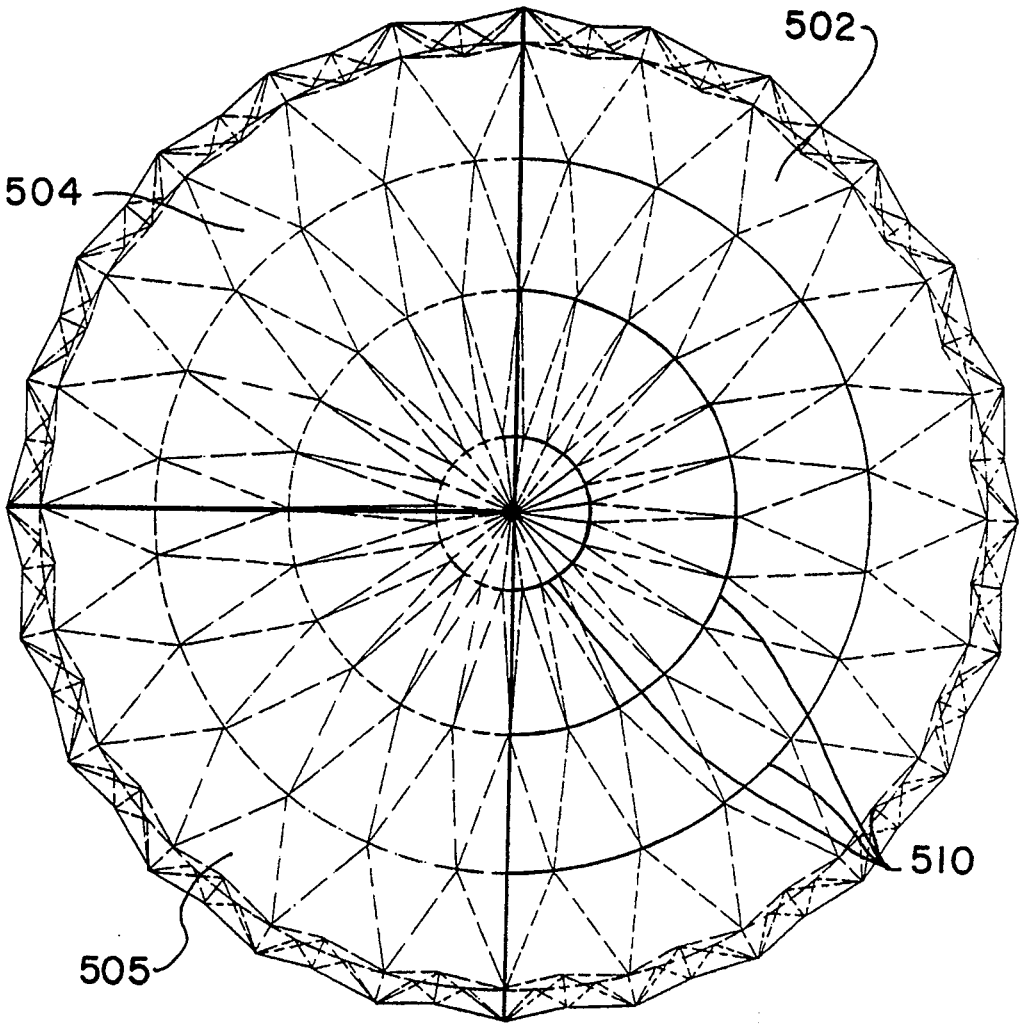
FIG. 13 is a plan view of an alternative embodiment of the present invention, showing a pair of retractable roof sections in the closed position.
Figure 14:
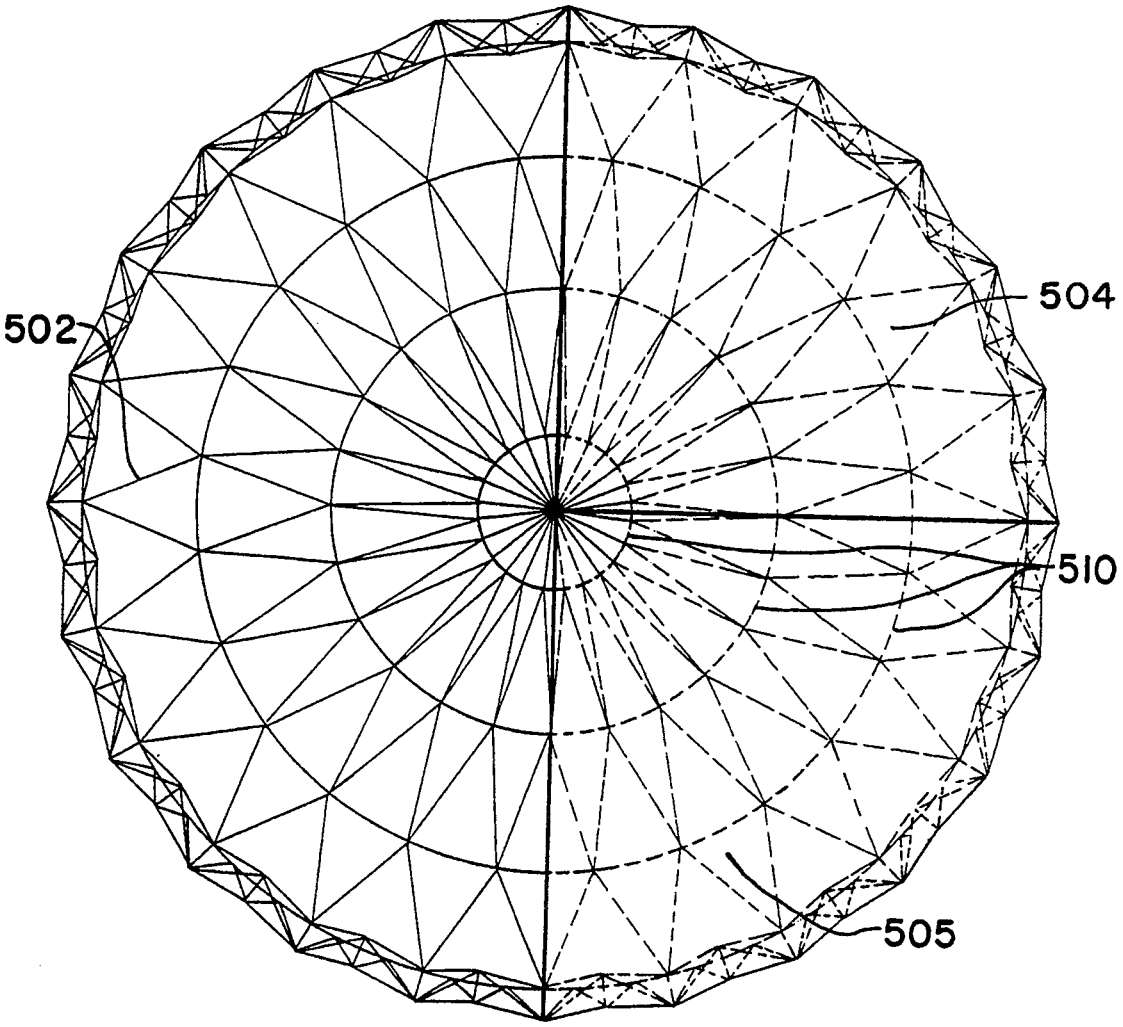
FIG. 14 is a plan view similar to FIG. 13 showing the retractable roof sections in the opened position.

Turning now to FIGS. 13 and 14, there is illustrated an alternative embodiment of the present invention in which a cable dome roof having a retractable roof portion is provided for a circular stadium or arena. In this embodiment, a triangulated cable arrangement 502 comprises a single inner tension member, such as an inner hoop-like tension member or single post, located at the center of the circle. As previously described with respect to a non-circular configuration, triangulated cable arrangement 502 further includes a plurality of circular tension hoops which are concentrically arranged at different heights relative to a common plane. A plurality of compression members are located on the tension hoops and a plurality of nodes are located on a circular compression ring so that the compression members and nodes, when viewed in plan, form the vertices of substantially isosceles triangles. Compression members define upper and lower nodes as described before, and upper tension members as well as diagonal tension members interconnect each compression member on a first tension hoop to a proximal pair of compression members on an adjacent tension hoop. In this manner, triangulated cable arrangement 502 is constructed. A fabric membrane is attached to a portion of triangulated cable arrangement 502 leaving a portion of the arrangement exposed.

A pair of retractable roof sections 504, 505 are provided which are rotatable between a closed position (FIG. 13) in which retractable roof sections 504, 505 overlay the uncovered portion of cable arrangement 502 and an opened position (FIG. 14) in which retractable roof sections nest above the covered portion of triangulated cable arrangement 502. Preferably, a plurality of circular rail assemblies 510 are provided on triangulated cable arrangement 502 to support and guide movement of retractable roof sections 504, 505, which are provided with wheel assemblies (not shown) which engage rail assemblies 510.

As is apparent from the description above, the present invention is well-suited for adapting triangulated structure to a wide variety of non-circular and circular configurations. A lightweight, triangulated design is realized which provides a cost-efficient, simple design having a retractable roof. Advantageously, such a design may be used to design stadiums or arenas having a natural grass playing surface.

While the invention has been described in conjunction with specific embodiments, it is evident that numerous alternatives, modifications, and variations will be apparent to those skilled in the art in light of the foregoing description.

I claim:

1. A cable dome roof having a retractable roof portion, comprising;

a triangulated cable arrangement for supporting a roof membrane;

a roof membrane fixed to a portion of said triangulated cable arrangement leaving a portion of said triangulated cable arrangement uncovered; and a pair of retractable roof sections movably secured to said triangulated cable arrangement, said retractable roof sections being movable between a closed position in which said sections overlay the uncovered portion of said triangulated cable arrangement and an opened position in which said sections nest above the covered portion of said triangulated cable arrangement.

2. The cable dome roof of claim 1 wherein said triangulated cable arrangement projects in plan a substantially closed non-circular curve having major and minor axes.

3. The cable dome roof of claim 2 wherein said triangulated cable arrangement comprises:

(i) a substantially horizontal outer compression ring;

(ii) first and second fixed end sectors;

(iii) an intermediate segment extending from said first end sector to said second end sector;

(iv) a substantially planar cable truss positioned along the major axis extending from the first end sector to the second end sector;

(v) a plurality of hoop-like tension members concentrically arranged about said substantially planar cable truss and within the non-circular curve at different heights relative to a common reference plane;

(vi) a plurality of substantially vertical compression members having upper and lower ends, located on each of said hoop-like tension members; and (vii) a plurality of tension elements interconnecting each compression member on a first hoop-like tension member to a pair of compression members on an adjacent hoop-like tension member.

4. The cable dome roof of claim 1 further comprising means for movably supporting said retractable roof sections.

5. The cable dome roof of claim 1 wherein said retractable roof sections are rotatable between the opened and closed positions.

6. The cable dome roof of claim 1 wherein said triangulated cable arrangement projects in plan a circular curve.

7. The cable dome roof of claim 6 wherein said triangulated cable arrangement comprises:

(i) an inner tension member;

(ii) a plurality of substantially horizontal tension hoops concentrically arranged about said inner tension member at different heights relative to a common reference plane;

(iii) a plurality of substantially vertical compression members having upper and lower ends, defining upper and lower nodes, affixed at their lower ends to one of said tension hoops, wherein each compression member located on a first tension hoop and a proximal pair of compression members on an adjacent tension hoop form, in plan, the vertices of a substantially isosceles triangle;

(iv) a plurality of tension elements interconnecting a first compression member affixed to said first tension hoop to said proximal pair of compression members affixed to said adjacent tension hoop;

(v) means for securing an innermost tension hoop and the compression members attached thereto to said inner tension member;

(vi) an outer compression member;

(vii) a plurality of nodes located on said outer compression member; and (viii) a plurality of tension elements interconnecting an outermost tension hoop and the compression members attached thereto to said nodes on said outer compression member.

8. The cable dome roof of claim 7 wherein said plurality of tension elements include:

(a) a pair of upper tension members extending from the upper node of said compression member affixed to said first tension hoop to the upper nodes of each of said proximal pair of compression members affixed to said adjacent tension hoop; and (b) a pair of diagonal tension members extending from said upper node of said compression member affixed to said first tension hoop to the lower nodes of each of said proximal pair of compression members affixed to said adjacent tension hoop.

9. A triangulated cable dome roof having a retractable roof portion, comprising:

(A) a triangulated cable arrangement for supporting a roof, including (i) an inner tension member;

(ii) a plurality of substantially horizontal tension hoops concentrically arranged about said inner tension member at different heights relative to a common reference plane;

(iii) a plurality of substantially vertical compression members having upper and lower ends, defining upper and lower nodes, affixed at their lower ends to one of said tension hoops, wherein each compression member located on a first tension hoop and a proximal pair of compression members on an adjacent tension hoop form, in plan, the vertices of a substantially isosceles triangle;

(iv) a plurality of tension elements interconnecting a first compression member affixed to said first tension hoop to said proximal pair of compression members affixed to said adjacent tension hoop, said tension elements including:

(a) a pair of upper tension members extending from the upper node of said compression member affixed to said first tension hoop to the upper nodes of each of said proximal pair of compression members affixed to said adjacent tension hoop; and (b) a pair of diagonal tension members extending from said upper node of said compression member affixed to said first tension hoop to the lower nodes of each of said proximal pair of compression members affixed to said adjacent tension hoop;

(v) means for securing an innermost tension hoop and the compression members attached thereto to said inner tension member;

(vi) an outer compression member;

(vii) a plurality of nodes located on said outer compression member;

(viii) a plurality of tension elements interconnecting an outermost tension hoop and the compression members attached thereto to said nodes on said outer compression member;

(B) a roof membrane fixed to a portion of said triangulated cable arrangement leaving a portion of said triangulated cable arrangement uncovered; and (C) a pair of retractable roof sections movably secured to said triangulated cable arrangement, said retractable roof sections being movable between a closed position in which said sections overlay the uncovered portion of said triangulated cable arrangement and an opened position in which said sections nest above the covered portion of said triangulated cable arrangement.

10. A cable dome for supporting a roof that projects in plan a substantially closed non-circular area, comprising:

first and second end sectors, said end sectors being fixed; and an intermediate segment extending from said first sector to said second sector, forming a substantially closed non-circular area, said intermediate segment further comprising an intermediate fixed roof portion and a retractable roof portion, wherein said retractable roof portion comprises a stationary underlying cable dome structure and retractable roof sections movably secured to said structure, said retractable roof sections being movable into nesting relationship with said intermediate fixed roof portion.

11. The cable dome of claim 10 wherein the fixed roof portion of said intermediate segment comprises a pair of spaced apart fixed roof sections and wherein said retractable roof portion comprises a pair of retractable roof sections each of which is movable from a first adjoining position to a second nesting position.

12. The cable dome of claim 11 wherein said intermediate segment further comprises means for movably supporting said retractable roof sections.

13. The cable dome of claim 12 wherein said supporting means comprise a plurality of parallel rails.

14. A triangulated roof structure for supporting a roof that projects in plan a substantially closed non-circular curve having major and minor axes, comprising:

a substantially horizontal outer compression ring;

first and second fixed end sectors;

an intermediate segment extending from said first end sector to said second end sector, said intermediate segment comprising a fixed roof portion and a retractable roof portion movable into a nesting relationship with said fixed roof portion;

a substantially planar cable truss positioned along the major axis extending from the first end sector to the second end sector;

a plurality of hoop-like tension members concentrically arranged about said substantially planar cable truss and within the non-circular curve at different heights relative to a common reference plane;

a plurality of substantially vertical compression members having upper and lower ends, located on each of said hoop-like tension members; and a plurality of tension elements interconnecting each compression member on a first hoop-like tension member to a pair of compression members on an adjacent hoop-like tension member.

15. The triangulated roof structure of claim 14 wherein said compression members in said end sectors are not radially aligned and wherein said compression members in said intermediate segment are aligned in columns which are generally parallel to the minor axis and which form a butterfly shape.

16. The triangulated roof structure of claim 15 wherein said tension elements interconnecting compression members in said end sectors comprise:

a pair of upper tension members extending from the upper end of a compression member affixed to a first tension hoop to the upper ends of a proximal pair of compression members affixed to an adjacent tension hoop; and a pair of diagonal tension members extending from the upper end of said compression member affixed to said first tension hoop to the lower ends of each of said proximal pairs of compression members affixed to said adjacent tension hoop.

17. The triangulated roof structure of claim 15 wherein said tension elements interconnecting compression members in said intermediate segment comprise:

a pair of diagonal tension members extending from the upper end of a compression member affixed to a first tension hoop to the lower end of each of a proximal pair of non-aligned compression members affixed to an adjacent tension hoop.

18. The triangulated roof structure of claim 14 wherein the fixed roof portion of said intermediate segment comprises a pair of fixed roof sections positioned along the outer compression ring on either side of the major axis and wherein said retractable roof portion comprises a pair of retractable roof sections each of which is movable from a closed position in which said retractable roof sections adjoin along the major axis, to an opened position in which said retractable roof sections nest with the fixed roof sections of said intermediate segment.

19. The triangulated roof structure of claim 18 wherein a plurality of parallel rails for movably supporting said pair of retractable roof sections are positioned above the upper end of the aligned compression members in said intermediate segment.

20. The triangulated roof structure of claim 18 wherein each of said retractable roof sections comprise a plurality of flexibly linked trusses.

21. The triangulated roof structure of claim 20 wherein said trusses are triangular trusses each having a horizontal base truss and a pair of inclined side trusses secured to said base truss which extend upward from said base truss to a common point.

22. A lightweight retractable roof section for a domed stadium comprising:

a substantially rectangular array of support members arranged in rows and columns;

means for flexibly interconnecting a first support member in each row of said array to an adjacent support member in said row;

means for flexibly linking a first support member in each column of said array to an adjacent support member in said column;

means for movably securing said array to an underlying structure so that said array is movable relative to said underlying structure from a closed position to an opened position; and drive means for moving said array between said opened and closed positions.

23. The lightweight retractable roof section of claim 22 wherein said support member comprise triangular trusses.

24. The lightweight retractable roof section of claim 23 wherein said linking means comprise a plurality of link members extending alternatively from a lower vertex of said first triangular truss to the upper vertex of said adjacent triangular truss or from the upper vertex of said first triangular truss to a lower vertex of said adjacent triangular truss.

25. The lightweight retractable roof section of claim 23 further comprising a plurality of arch members extending from a first truss in each column to an adjacent truss in said column, for supporting a fabric roof.

26. The lightweight retractable roof section of claim 22 wherein said means for movably securing said array to the underlying structure comprises a wheel assembly having wheels which engage an assembly of parallel rails on the underlying structure and means to carry an uplift load.

27. The lightweight retractable roof section of claim 26 wherein said drive means comprise a motor operatively associated with said wheel housing for rotating said wheels, thereby moving said array.

28. The lightweight retractable roof section of claim 26 wherein said drive means comprises a cable pull system.

29. A cable dome roof for an underlying building space that projects in plan a substantially closed non-circular curve having major and minor axes, comprising:

a pair of fixed roof end sectors;

an intermediate segment extending from the first end sector to the second end sector, forming a substantially closed non-circular area;

a roof membrane covering said pair of fixed roof end sectors and a portion of said intermediate segment so as to leave a portion of said intermediate segment uncovered;

a pair of retractable roof sections movably secured to said intermediate segment, each of said sections being movable from a closed position in which said sections overlay the uncovered portion of said intermediate segment and an open position in which said sections nest above the covered portion of said intermediate segment; and means for movably securing said pair of retractable roof sections to said intermediate segment.

30. The cable dome roof of claim 29 wherein said intermediate segment and said end sectors comprise:

a substantially planar cable truss positioned along the major axis;

a plurality of hoop-like tension members concentrically arranged about said substantially planar cable truss and within the non-circular curve at different heights relative to a common reference;

a plurality of substantially vertical compression members having upper and lower ends, located on each of said hoop-like tension members; and a plurality of tension elements interconnecting each compression member on a first hoop-like tension member to a pair of compression members on an adjacent hoop-like tension member.

31. The cable dome roof of claim 30 wherein said compression members located in said end sectors are not radially aligned and wherein said compression members located in said intermediate segment are aligned in columns which are generally parallel to the minor axis and which form a butterfly shape.

32. The cable dome roof of claim 31 wherein said tension elements interconnecting compression members in said end sectors comprise:

a pair of upper tension members extending from the upper end of a compression member affixed to a first tension hoop to the upper ends of a proximal pair of compression members affixed to an adjacent tension hoop; and a pair of diagonal tension members extending from the upper end of said compression member affixed to said first tension hoop to the lower ends of each of said proximal pairs of compression members affixed to said adjacent tension hoop.

33. The cable dome roof of claim 31 wherein said tension elements interconnecting compression members in said intermediate segment comprise:

a pair of diagonal tension members extending from the upper end of a compression member affixed to a first tension hoop to the lower end of each of a proximal pair of non-aligned compression members affixed to an adjacent tension hoop.

34. The cable dome roof of claim 29 wherein said means for movably securing said retractable roof sections to said intermediate segment comprise a plurality of parallel rails positioned atop the upper end of the compression members in said intermediate segment.

35. The cable dome roof of claim 34 wherein said retractable roof sections include wheel means for engaging said parallel rails.

36. The cable dome roof of claim 29 wherein each of said retractable roof sections comprise:

a substantially rectangular array of triangular trusses;

means for flexibly interconnecting a first triangular truss in each row of said array to an adjacent triangular truss in said row; and means for flexibly linking a first triangular truss in each column of said array to an adjacent triangular truss in said column.

37. A cable dome roof having a retractable roof portion, comprising;

a triangulated cable arrangement for supporting a roof membrane;

a roof membrane fixed to a portion of said triangulated cable arrangement leaving a portion of said triangulated cable arrangement uncovered; and a plurality of retractable roof sections movably secured to said triangulated cable arrangement, said retractable roof sections being movable between a closed position in which said sections overlay the uncovered portion of said triangulated cable arrangement and an opened position in which said sections nest above the covered portion of said triangulated cable arrangement.

38. The cable dome roof of claim 37 wherein said triangulated cable arrangement projects in plan a substantially closed non-circular curve having major and minor axes.

39. The cable dome roof of claim 38 wherein said triangulated cable arrangement comprises:

(i) a substantially horizontal outer compression ring;

(ii) first and second fixed end sectors;

(iii) an intermediate segment extending from said first end sector to said second end sector;

(iv) a substantially planar cable truss positioned along the major axis extending from the first end sector to the second end sector;

(v) a plurality of hoop-like tension members concentrically arranged about said substantially planar cable truss and within the non-circular curve at different heights relative to a common reference plane;

(vi) a plurality of substantially vertical compression members having upper and lower ends, located on each of said hoop-like tension members; and (vii) a plurality of tension elements interconnecting each compression member on a first hoop-like tension member to a pair of compression members on an adjacent hoop-like tension member.

40. The cable dome roof of claim 37 further comprising means for movably supporting said retractable roof sections.

41. The cable dome roof of claim 37 wherein said retractable roof sections are rotatable between the opened and closed positions.

42. The cable dome roof of claim 37 wherein said triangulated cable arrangement projects in plan a circular curve.

43. The cable dome roof of claim 42 wherein said triangulated cable arrangement comprises:

(i) an inner tension member;

(ii) a plurality of substantially horizontal tension hoops concentrically arranged about said inner tension member at different heights relative to a common reference plane;

(iii) a plurality of substantially vertical compression members having upper and lower ends, defining upper and lower nodes, affixed at their lower ends to one of said tension hoops, wherein each compression member located on a first tension hoop and a proximal pair of compression members on an adjacent tension hoop form, in plan, the vertices of a substantially isosceles triangle;

(iv) a plurality of tension elements interconnecting a first compression member affixed to said first tension hoop to said proximal pair of compression members affixed to said adjacent tension hoop;

(v) means for securing an innermost tension hoop and the compression members attached thereto to said inner tension member;

(vi) an outer compression member;

(vii) a plurality of nodes located on said outer compression member; and (viii) a plurality of tension elements interconnecting an outermost tension hoop and the compression members attached thereto to said nodes on said outer compression member.

44. The cable dome roof of claim 43 wherein said plurality of tension elements include:

(a) a pair of upper tension members extending from the upper node of said compression member affixed to said first tension hoop to the upper nodes of each of said proximal pair of compression members affixed to said adjacent tension hoop; and (b) a pair of diagonal tension members extending from said upper node of said compression member affixed to said first tension hoop to the lower nodes of each of said proximal pair of compression members affixed to said adjacent tension hoop.

45. A triangulated cable dome roof having a retractable roof portion, comprising:

(A) a triangulated cable arrangement for supporting a roof, including (i) an inner tension member;

(ii) a plurality of substantially horizontal tension hoops concentrically arranged about said inner tension member at different heights relative to a common reference plane;

(iii) a plurality of substantially vertical compression members having upper and lower ends, defining upper and lower nodes, affixed at their lower ends to one of said tension hoops, wherein each compression member located on a first tension hoop and a proximal pair of compression members on an adjacent tension hoop form, in plan, the vertices of a substantially isosceles triangle;

(iv) a plurality of tension elements interconnecting a first compression member affixed to said first tension hoop to said proximal pair of compression members affixed to said adjacent tension hoop, said tension elements including:

(a) a pair of upper tension members extending from the upper node of said compression member affixed to said first tension hoop to the upper nodes of each of said proximal pair of compression members affixed to said adjacent tension hoop; and (b) a pair of diagonal tension members extending from said upper node of said compression member affixed to said first tension hoop to the lower nodes of each of said proximal pair of compression members affixed to said adjacent tension hoop;

(v) means for securing an innermost tension hoop and the compression members attached thereto to said inner tension member;

(vi) an outer compression member;

(vii) a plurality of nodes located on said outer compression member;

(viii) a plurality of tension elements interconnecting an outermost tension hoop and the compression members attached thereto to said nodes on said outer compression member;

(B) a roof membrane fixed to a portion of said triangulated cable arrangement leaving a portion of said triangulated cable arrangement uncovered; and (C) a plurality of retractable roof sections movably secured to said triangulated cable arrangement, said retractable roof sections being movable between a closed position in which said sections overlay the uncovered portion of said triangulated cable arrangement and an opened position in which said sections nest above the covered portion of said triangulated cable arrangement.

46. A cable dome roof for an underlying building space that projects in plan a substantially closed non-circular curve having major and minor axes, comprising:

a pair of fixed roof end sectors;

an intermediate segment extending from the first end sector to the second end sector, forming a substantially closed non-circular area;

a roof membrane covering said pair of fixed roof end sectors and a portion of said intermediate segment so as to leave a portion of said intermediate segment uncovered;

a plurality of retractable roof sections movably secured to said intermediate segment, each of said sections being movable from a closed position in which said sections overlay the uncovered portion of said intermediate segment and an open position in which said sections nest above the covered portion of said intermediate segment; and means for movably securing said plurality of retractable roof sections to said intermediate segment.

47. The cable dome roof of claim 46 wherein said intermediate segment and said end sectors comprise:

a substantially planar cable truss positioned along the major axis;

a plurality of hoop-like tension members concentrically arranged about said substantially planar cable truss and within the non-circular curve at different heights relative to a common reference;

a plurality of substantially vertical compression members having upper and lower ends, located on each of said hoop-like tension members; and a plurality of tension elements interconnecting each compression member on a first hoop-like tension member to a pair of compression members on an adjacent hoop-like tension member.

48. The cable dome roof of claim 47 wherein said compression members located in said end sectors are not radially aligned and wherein said compression members located in said intermediate segment are aligned in columns which are generally parallel to the minor axis and which form a butterfly shape.

49. The cable dome roof of claim 48 wherein said tension elements interconnecting compression members in said end sectors comprise:

a pair of upper tension members extending from the upper end of a compression member affixed to a first tension hoop to the upper ends of a proximal pair of compression members affixed to an adjacent tension hoop; and a pair of diagonal tension members extending from the upper end of said compression member affixed to said first tension hoop to the lower ends of each of said proximal pairs of compression members affixed to said adjacent tension hoop.

50. The cable dome roof of claim 48 wherein said tension elements interconnecting compression members in said intermediate segment comprise:

a pair of diagonal tension members extending from the upper end of a compression member affixed to a first tension hoop to the lower end of each of a proximal pair of non-aligned compression members affixed to an adjacent tension hoop.

51. The cable dome roof of claim 46 wherein said means for movably securing said retractable roof sections to said intermediate segment comprise a plurality of parallel rails positioned atop the upper end of the compression members in said intermediate segment.

52. The cable dome roof of claim 51 wherein said retractable roof sections include wheel means for engaging said parallel rails.

53. The cable dome roof of claim 46 wherein each of said retractable roof sections comprise:

a substantially rectangular array of triangular trusses;

means for flexibly interconnecting a first triangular truss in each row of said array to an adjacent triangular truss in said row; and means for flexibly linking a first triangular truss in each column of said array to an adjacent triangular truss in said column.

* * * * *